US005312296A

United States Patent [19]

Aalto et al.

[11] Patent Number: 5,312,296

[45] Date of Patent: May 17, 1994

[54] FALSE-CEILING CONSTRUCTION AND METHOD FOR THE FLOW OF AIR IN CONNECTION WITH A FALSE-CEILING CONSTRUCTION

[75] Inventors: Erkki Aalto, Kausala; Teuvo Pellinen, Villähde; Pekka Kyllönen, Lahti, all of Finland

[73] Assignee: Halton OY, Finland

[21] Appl. No.: 768,860

[22] PCT Filed: Jan. 30, 1991

[86] PCT No.: PCT/FI91/00030

§ 371 Date: Sep. 25, 1991

§ 102(e) Date: Sep. 25, 1991

[87] PCT Pub. No.: WO91/11272

PCT Pub. Date: Aug. 8, 1991

[30] Foreign Application Priority Data

Jan. 31, 1990 [FI] Finland ..... 900496

[51] Int. Cl.[5] ..... F24F 7/10

[52] U.S. Cl. ..... 454/66; 126/299 R; 454/252

[58] Field of Search ..... 126/299 R, 299 D; 454/46, 66, 237, 252

[56] References Cited

U.S. PATENT DOCUMENTS

| | | | |
|---|---|---|---|
| 3,396,651 | 8/1968 | Kamiya et al. | 454/49 |
| 3,585,919 | 6/1971 | Culpepper, Jr. | 126/299 D X |
| 3,890,887 | 6/1975 | Kaufman et al. | 126/299 D |
| 3,955,949 | 5/1976 | Rohrer | 126/299 D X |
| 4,072,143 | 2/1978 | Gaylord | 126/299 D |
| 4,134,394 | 1/1979 | Otenbaker | 126/299 D |
| 4,373,509 | 2/1983 | Neitzel et al. | 126/299 D |
| 4,462,387 | 7/1984 | Welsh | 126/299 R |
| 4,475,534 | 10/1984 | Moriarty | 126/299 D |
| 4,896,657 | 1/1990 | Glassman | 126/299 D |
| 4,944,285 | 7/1990 | Glassman | 126/299 D |

FOREIGN PATENT DOCUMENTS

| | | | |
|---|---|---|---|
| 2718611 | 11/1978 | Fed. Rep. of Germany . | |
| 3801425 | 8/1989 | Fed. Rep. of Germany | 454/49 |
| 5891 | 1/1981 | Finland . | |
| 459324 | 6/1989 | Sweden . | |
| 1180852 | 2/1970 | United Kingdom . | |

*Primary Examiner*—Harold Joyce
*Attorney, Agent, or Firm*—Steinberg & Raskin

[57] ABSTRACT

False-ceiling construction (10), which is intended in particular for institutional kitchens and which false-ceiling construction is composed of modular units, which comprise at leat an intake air unit (11) and an exhaust air unit (18) and, in the area between them, a false-ceiling plate (25), and which false-ceiling construction is formed underneath the ceiling construction (C) proper in a room. The false-ceiling construction (10) includes at least one flow opening (15), passing from the intake air chamber (13) in the intake air unit (11), for a trap-air jet ($L_{1a}$) for making the trap-air jet ($L_{1a}$) to flow as parallel to the plane (T) of the false-ceiling plate (25) or as slightly inclined in relation to said plane towards the exhaust air opening (20), placed on the exhaust air chamber (19), for the exhaust air flow ($L_2$). The invention further concerns a method for the flow of air in connection with the false-ceiling construction.

5 Claims, 3 Drawing Sheets

FALSE-CEILING CONSTRUCTION AND METHOD FOR THE FLOW OF AIR IN CONNECTION WITH A FALSE-CEILING CONSTRUCTION

The invention concerns a false-ceiling construction and a method for the flow of air in connection with a false-ceiling construction.

The installation of intake air devices, exhaust air devices, electric fittings and other technical means in rooms frequently causes great difficulties, especially in the case of after-installation. The object of the present invention is to provide a ceiling construction of a novel type, which operates as a so-called technical ceiling and comprises exhaust and intake air units, lighting, electricity, and regulators or air quantity, to be installed in a modular way.

In prior art, the use of a false-ceiling construction is known. However, the prior-art false-ceiling constructions do not permit modular installation of intake and exhaust air equipment.

The object of the invention is to provide a false-ceiling construction intended in particular for institutional kitchens and equivalent, comprising an exhaust air unit and an intake air unit. Through the exhaust air unit, the impurities produced on the making of food in the kitchen are sucked off, while the exhaust air unit includes a fat filter, which performs the filtering of the impurities. In the invention, it has been realized to form a false-ceiling construction whose intake air unit includes at least one such duct opening through which a carrier-air and trap-air jet is produced towards the fat filters in the exhaust air unit. Thus, in the false-ceiling construction in accordance with the invention, the impurities cannot be gathered in the space between the exhaust air unit and the intake air unit at the proximity of the ceiling module placed between said units. The trap-air jet efficiently guides the impurities and/or the excess heat produced at the food-making sites placed below the exhaust air unit in the kitchen space to the fat filters, and in this way a gathering of the impurities at the proximity of the ceiling module in the top portion of the room space is prevented.

In the method in accordance with the invention, it has been realized to make use of a trap-air or carrier-air jet, which is directed as parallel to the surface plane of the ceiling module or as slightly inclined towards the exhaust air opening of the exhaust air unit and towards the fat filters placed in same. The intake air unit can also be placed so that the carrier-air jet opening on the intake air unit is placed at a level somewhat lower than the level of the fat filters, in which case the carrier-air jet can be made to flow as slightly inclined upwards, and in this way the flow of impurities into the fat filters can be intensified further.

The false-ceiling construction in accordance with the invention is mainly characterized in that the false-ceiling construction includes at least one flow opening, passing from the intake air chamber in the intake air unit, for a trap-air jet for making the trap-air jet to flow as parallel to the plane of the false-ceiling plate or as slightly inclined in relation to said plane towards the exhaust air opening, placed on the exhaust air chamber, for the exhaust air flow, whereby, by means of the trap-air jet, contaminated air and/or excessive heat or excessive humidity rising from the sources of impurities in the room space is attracted towards the exhaust air unit, and in this way gathering of impurities and/or excessive heat and/or excessive humidity in the area between the intake air unit and the exhaust air unit at the proximity of the false-ceiling plate of the false-ceiling construction is prevented.

The method in accordance with the invention for the flow of air in connection with a false-ceiling construction is mainly characterized in that air is made to flow through the intake air unit into the room space so that it is directed from the intake air unit at a relatively high velocity as parallel to the plate plane of the false-ceiling plate or as slightly inclined in relation to said plate plane towards the opening for exhaust air flow, which opens into the exhaust air chamber in the exhaust air unit, whereby said trap-air flow operates as a carrier-air jet for passing the impurities and/or excessive heat and/or excessive humidity produced at the food-making means in the kitchen space directly towards the exhaust air opening for the exhaust air flow, placed at the exhaust air unit, while the exhaust air opening preferably includes fat filters, whereby, by means of said trap-air flow, gathering of excessive heat and/or of impurities and/or of excessive humidity at the proximity of the false-ceiling plate in the false-ceiling construction in the area between the intake air unit and the exhaust air unit is prevented.

In the following, the invention will be described with reference to some preferred embodiments of the invention illustrated in the figures in the accompanying drawing, the invention being, yet, not supposed to be confined to said embodiments alone.

Figure 1A:
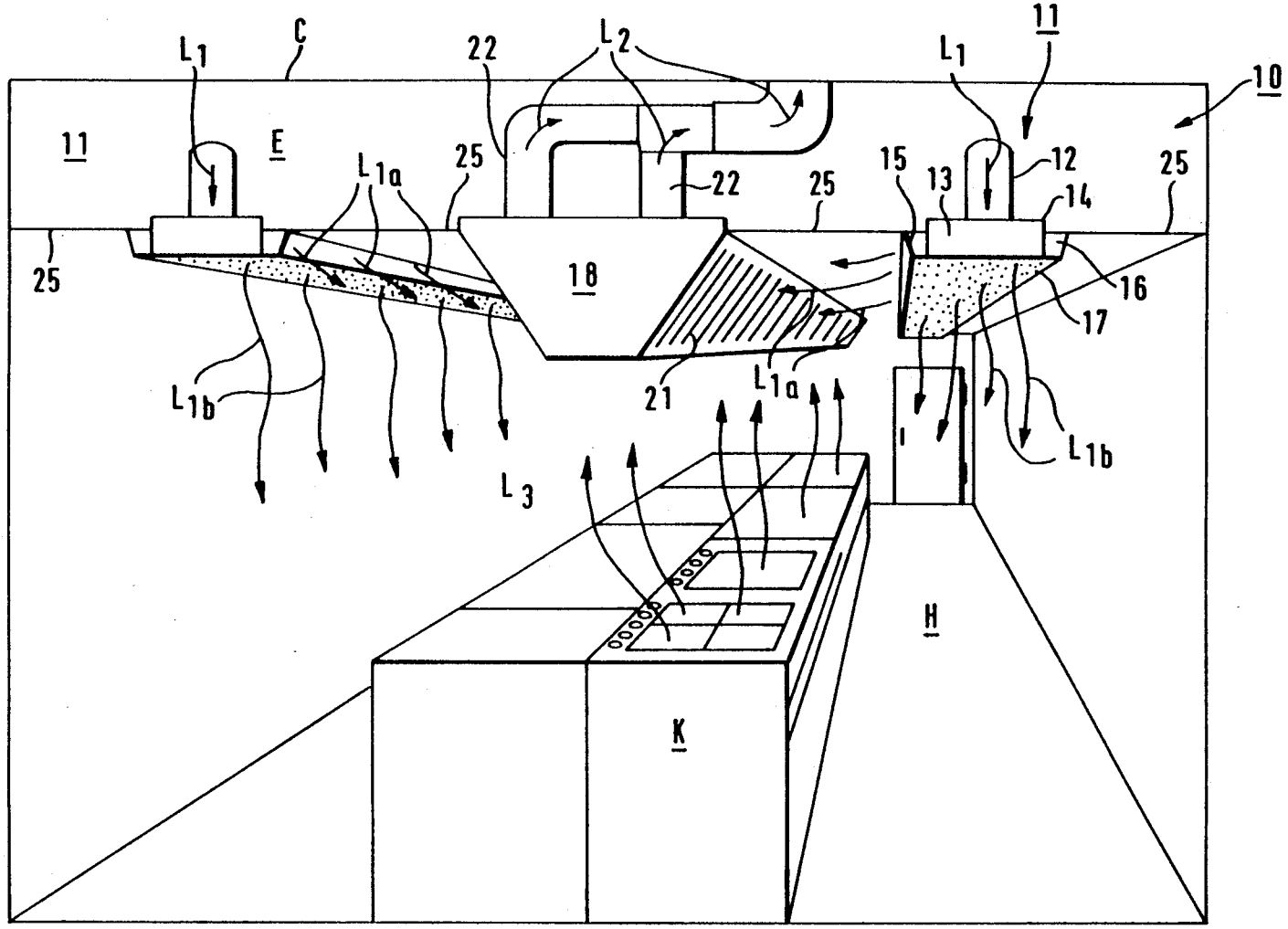
FIG. 1A is an axonometric view of a false-ceiling construction in accordance with the invention, intended for institutional kitchens.

FIG. 1A shows the construction of a technical false-ceiling construction in accordance with the invention. The false ceiling 10 is a modular construction, which comprises at least the following structural components of a modular construction: an intake air unit 11, an exhaust air unit 18, a ceiling module, i.e. a false-ceiling plate 25 between the intake air unit 11 and the exhaust air unit 18.

As is shown in FIG. 1A, fresh intake air $L_1$ is introduced into the room space H through the intake air device 11. Out of the intake air duct 12, the air is made to flow into the intake air chamber 13 in the intake air unit 11, which chamber is defined by the box frame 14. The air is passed out of the intake air chamber 13 through the duct opening 15, as a carrier-air jet $L_{1a}$, towards the fat filters 21 in the exhaust air device 18. The flow of air takes place at the proximity of the false-ceiling plate 25. By means of the trap-air jet $L_{1a}$, the impurities rising from the food-making means K in the kitchen are directed straight into the filters 21.

Thus, by means of the trap-air jet $L_{1a}$, gathering of impurities in the area between the intake air unit 11 and the exhaust air unit 18 at the proximity of the false-ceiling plate 25 is prevented. As is shown in FIG. 1A, air is further passed into the room space H through a second duct opening 16 on the intake air unit straight downwards $L_{1b}$. By means of the perforated plate 17, a sufficiently low flow velocity is obtained for the air flow $L_{1b}$. In this way, a sensation of draught is prevented in the zone of stay of the kitchen personnel working in the kitchen space.

Air is removed out of the kitchen space H through the exhaust air ducts 22 in the exhaust air device 18. The exhaust air flow is denoted with the arrows $L_2$.

As is shown in the figure, the false-ceiling plate 25 is placed between the exhaust air unit 18 and the intake air unit 11 and is supported on the frame constructions of both of said units. Thus, the false-ceiling plate 25 rests on support of the intake air unit 11 and of the exhaust air unit 18.

The construction is modular and comprises a number of different standard widths of the false-ceiling plate 25. Thus, in accordance with the requirements of each space, it is possible to form a different ceiling arrangement, in which it has been possible to choose the spacing between the intake air units and the exhaust air units in the desired way and based on the requirements of the space.

As is shown in FIG. 1A, fresh intake air is made to flow out of the intake air chamber 13 defined by the box construction 14 of the intake air unit 11 through the intake air opening 15. The trap-air jet $L_{1a}$ attracts contaminated air $L_3$ rising from the food-making sites. The exhaust air $L_2$ is removed out of the room space, said exhaust air $L_2$ consisting of the flow $L_3+L_{1a}$.

As is shown in FIG. 1A, air is also made to flow downwards out of the intake air unit 11 through the flow opening 16 of the box construction, which is covered by a perforated face 17, and said flow is denoted with the arrows $L_{1b}$. The flow $L_{1b}$ has a low velocity, and in this way a sensation of draught is avoided in the zone of stay in the kitchen space (H).

Figure 1B:
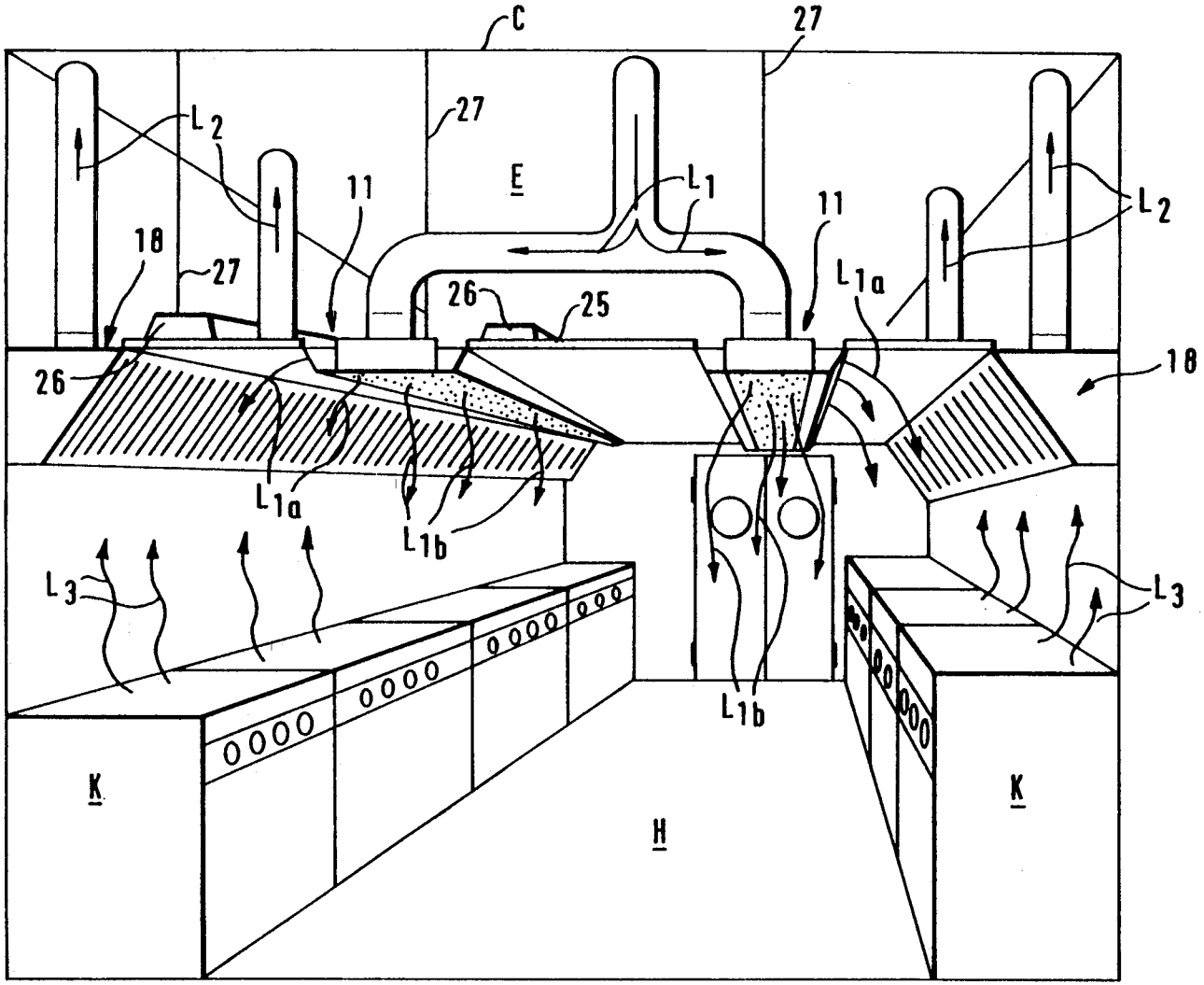
FIG. 1B shows a second preferred embodiment of a false-ceiling construction in accordance with the invention.

FIG. 1B shows a second object of use of a false-ceiling construction in accordance with the invention in an institutional kitchen. By means of a modular construction, a novel assembly of modular parts has been formed. The different variations of design permitted by the modular construction have been utilized as the ceiling plate can be chosen optionally from among different widths and lengths.

As is shown in the figure, between the false-ceiling plate 25 and the ceiling construction C proper, there is a free space E, in which the various installation means for the support of the ceiling construction can be placed. As is shown in FIG. 1B, the false-ceiling plate 25 includes installation troughts 26, through which the electricity means, water pipes, etc. necessary technical installations can be passed.

As is shown in FIG. 1B, the intake air unit 11 and the exhaust air unit 18 are supported on the ceiling C proper by means of support constructions 27. The support constructions may comprise, for example, a steel rope or equivalent, one of whose ends is attached to the ceiling and the other end to the false-ceiling construction.

Figure 2:
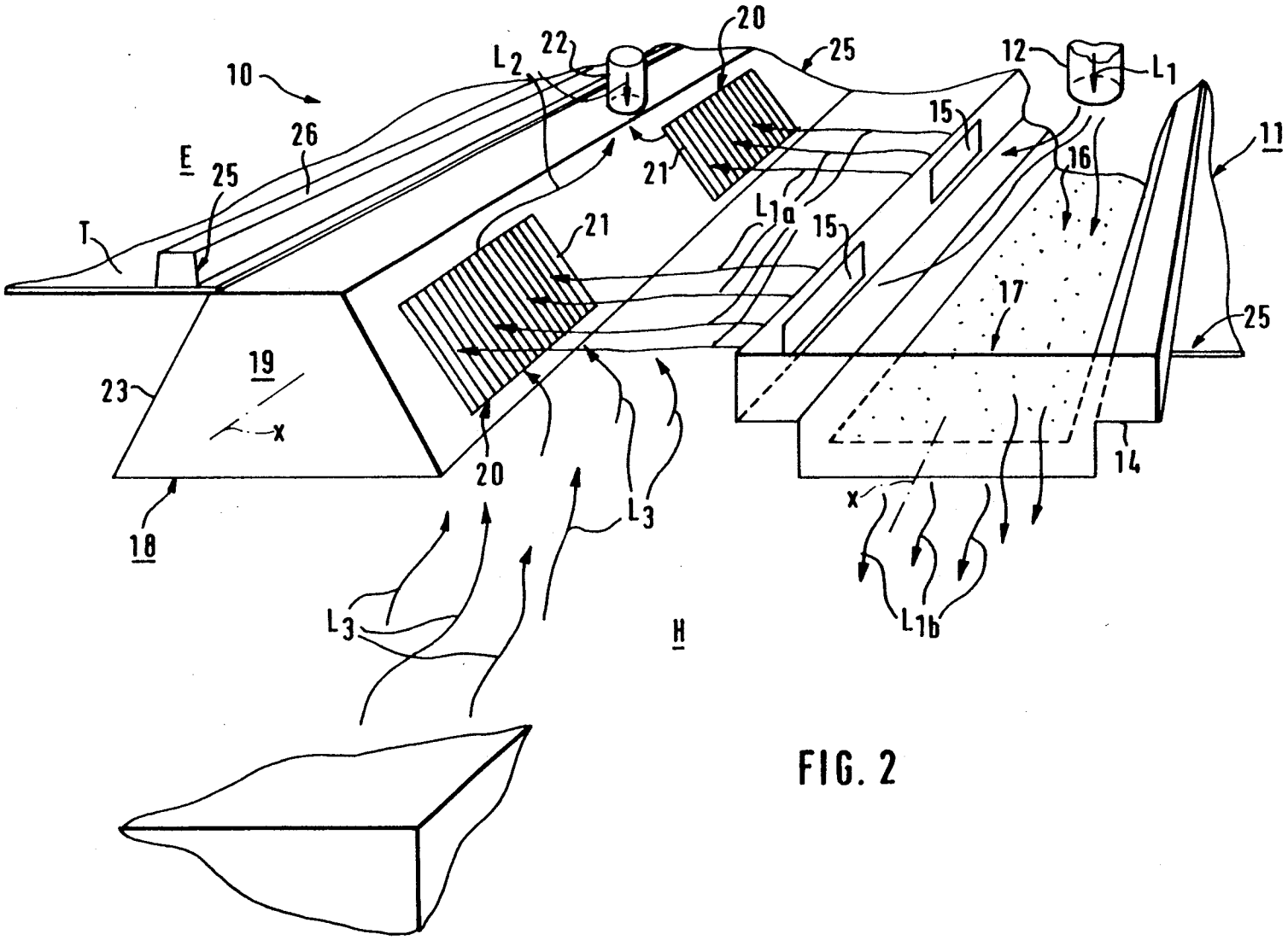
FIG. 2 shows the relative locations of the intake air unit, the exhaust air unit, and of the ceiling module between them.

FIG. 2 is a more detailed illustration of the false-ceiling construction in accordance with the invention and of the method in accordance with the invention for the flow of air in connection with the false-ceiling construction. The figure is an illustration in part and shows the principle. The false-ceiling construction 10 comprises an intake air unit 11 and an exhaust air unit 18, shown in the figure. Intake air is made to flow out of the intake air duct 12 in the intake air unit 11 into the intake air chamber 13 in the unit, which chamber 13 is defined by the box 14 of the intake air chamber. The box construction includes an air flow opening 15 for the trap-air jet $L_{1a}$ and an air flow opening 16 for general ventilation. The flow opening 16 is covered by a perforated plate 17, whereby a low velocity is obtained for the flow $L_{1b}$. and thereby a sensation of draught is avoided in the zone of stay of the people working in the kitchen space.

Thus, as is shown in FIG. 2, the trap-air and carrier-air jet $L_{1b}$ is directed towards the exhaust air unit 18. The exhaust air unit 18 comprises an exhaust air chamber 19, which is defined by the box 23 of the exhaust air chamber. The box 23 includes an opening 20 for the exhaust air flow $L_2$, which opening opens into an exhaust air chamber 19 placed inside the box construction. A fat filter 21 is placed in connection with the opening 20. The exhaust air opening 20 is placed on the inclined face 24 of the box 23. The air flow is passed further, in the way shown in the figure, along the longitudinal axis X of the box-shaped exhaust air chamber towards the exhaust air duct 22 opening into the chamber. The air flow is passed through the exhaust air duct 22 further out of connection with the construction (by the effect of the suction produced by a blower, not shown). The exhaust air duct 22 is placed at one end of the oblong box construction 23. As is shown in the figure, both the intake air unit 11 and the exhaust air unit 18 are supported on the ceiling construction C proper. The false-ceiling plate 25 is placed in the area between the intake air unit 11 and the exhaust air unit 18. The false-ceiling plate 25 rests on support of the intake air unit 11 and the exhaust air unit 18. On the false-ceiling plate 25, a trough 26 is fitted for technical installations, such as electricity. On top of the false-ceiling plate 25, it is possible to place a trough 26 for water pipes for a sprinkler system. Thus, in the constructions in accordance with the invention, efficient use has been made of the free space E between the false-ceiling construction 10 and the ceiling C proper. The oblong troughs 26 run on top of the false-ceiling plate 25.

As is shown in FIG. 2, the intake air unit further includes a light fitting 28.

By means of a carrier-air jet $L_{1a}$ in accordance with the invention, the air of excessively high temperature, water vapour, and impurities rising from the sources of impurities in the kitchen are passed efficiently through fat filters into the exhaust air chamber and further out of the kitchen premises. The flow $L_{1a}$ is parallel to the plane T of the false-ceiling plate 25 of the ceiling module or slightly inclined up or down in relation to said plate plane T. As is shown in FIG. 2, air of general ventilation is made to flow out of the intake air chamber 13 in the intake air unit 11 through the perforated plate 17. Said air flows at a relatively low velocity into the room space, and in this way a sensation of draught is avoided. On the contrary, the flow $L_{1a}$ is given a high velocity and a high impulse, and said flow is made to extend effectively up to the fat filters 21 in the exhaust air unit 18. Thus, by means of the arrangement in accordance with the invention, gathering of contaminated air in the kitchen at the proximity of the false-ceiling plate 25 in the area between the exhaust air unit 18 and the intake air unit 11 is prevented.

The false-ceiling construction in accordance with the invention also includes an intake air unit which comprises a flow opening for the trap-air jet $L_{1a}$ alone and an intake air unit which comprises a flow opening for the intake air flow $L_{1b}$ of general ventilation alone. Moreover, the construction may include so-called blind modules, which act only as support points for the false-ceiling plates and through which no air is passed or which include light fittings only. The modular false-ceiling construction further includes air-quantity regulators in connection with the intake air unit and the exhaust air unit. The false-ceiling construction in accordance with the invention permits the formation of an integrated technical ceiling, in which, by means of one installation operation, all the technical facilities required by the room can be accomplished.

We claim:

1. False-ceiling construction (10), which is intended in particular for institutional kitchens and which false-ceiling construction is composed of modular units, which comprise at least an intake air unit (11) and an exhaust air unit (18) and, in the area between them, a false-ceiling plate (25), and which false-ceiling construction is formed underneath a ceiling (C) proper in a room, a free space (E) remaining between the false-ceiling construction (10) and the ceiling (C) proper of the room, which false-ceiling construction (10) comprises an intake air duct (12) for the flow ($L_1$) of fresh air to be passed into the room, said duct (12) being connected to a box (14) which defines the intake air chamber in the intake air unit, and from which intake air chamber (13) in the intake air unit (11) at least one flow opening (15, 16) is opened for the flow of fresh air entering into the room, and that the false-ceiling construction comprises an exhaust air unit (18), which comprises a box-shaped frame (23), which defines an exhaust air chamber (19) in its interior, an opening for the exhaust air flow ($L_2$) being opened from the room space into the exhaust air chamber (19), which opening includes fat filters (21) in its connection, and which exhaust air chamber (19) is fitted to be placed in the false-ceiling construction above the food-making means placed in the room space, and that the false-ceiling construction (10) comprises the false-ceiling plate (25) to be installed in a modular way, at least one false-ceiling plate (25) being fitted in the area between the intake air unit (11) and the exhaust air unit (18), and that the false-ceiling construction is supported by means of a support construction (27) on the ceiling (C) proper of the room space, characterized in that the false-ceiling construction (10) includes a first flow opening (15) structured and arranged to pass fresh air therethrough from the intake air chamber (13) in the intake air unit (11) to the room space (H), such that a trap-air jet ($L_{1a}$) flows parallel to the plane (T) of the false-ceiling plate 25 or as slightly inclined in relation to said plane towards the exhaust air opening (20), placed on the exhaust air chamber (19), for the exhaust air flow ($L_2$), whereby, by means of the trap-air jet ($L_{1a}$), contaminated air and/or excessive heat or excessive humidity ($L_3$) rising from the sources of impurities in the room space is attracted towards the exhaust air unit (18) and removed from the room space (H), and in this way gathering of impurities and/or excessive heat and/or excessive humidity in the area between the intake air unit (11) and the exhaust air unit (18) at the proximity of the false-ceiling plate (25) of the false-ceiling construction is prevented, the box (14), which defines said intake air chamber, is provided with a second flow opening (16) at its bottom for guiding an air flow ($L_{1b}$) directly downwards, said second flow opening (16) including a perforated plate (17) for the purpose of guiding the air flow ($L_{1b}$) at a low velocity into a working zone of personnel working in the kitchen, whereby a detrimental sensation of draft in the working zone is avoided.

2. False-ceiling construction as claimed in claim 1, characterized in that the false-ceiling construction includes at least one installation trough (26) on the top face of the false-ceiling plate (25), whereby, through the trough, electricity fittings and/or water pipes can be passed to their respective appliances and whereby the free space (E) between the false-ceiling construction (10) and the ceiling (C) proper of the room space can be utilized efficiently.

3. False-ceiling construction as claimed in claim 1, characterized in that both the box (14) of the intake air unit (11) and the box frame (23) of the exhaust air unit (18) are oblong tubular constructions, at which the air flow connections for intake and exhaust are placed at one end of the box construction, in which case it is possible centrally to collect exhaust air flows from different points across the width of the room space through openings (20) for exhaust air flows, and through filters (21) placed in said openings, into the exhaust air chamber and out of the exhaust air chamber further centrally away along the exhaust air duct (22), and in which construction the intake air unit (11) also includes such a box-shaped frame construction (14) as comprises a number of air inlet flow openings (15) placed on the oblong construction, through which inlet flow openings the trap-air jets ($L_{1a}$) can be directed from the desired points across the width of the room space towards the fat filters (21) placed facing said inlet openings in the exhaust air unit (18).

4. A method for the flow of air in connection with a false-ceiling construction (10), comprising installing a false-ceiling construction (10) underneath a ceiling (C) proper of a room space (H), the false-ceiling construction (10) comprising an intake air unit (11), an exhaust air unit (18) and a false-ceiling plate (25) between the intake air unit (11) and the exhaust air unit (18), providing a free space (E) between the false-ceiling construction (10) and the ceiling (C) proper of the room space, supporting the false-ceiling construction (10) on the ceiling (C) proper of the room space, flowing fresh air to the intake air unit (11), directing the air from the intake air unit (11) into the room space (H) as a trap-air flow ($L_{1a}$) at a relatively high velocity parallel to a plate plane (T) of the false-ceiling plate (25) or as slightly inclined in relation to said plate plane (T) towards an exhaust air opening (20) for exhaust flow ($L_2$), which exhaust air opening (20) opens into an exhaust air chamber (19) in the exhaust air unit (18), whereby said trap-air flow ($L_{1a}$) operates as a carrier-air jet, passing the impurities and/or excessive heat and/or excessive humidity produced at the food-making means in the kitchen space directly towards the exhaust air opening (20) for the exhaust air flow ($L_2$), placed at the exhaust air unit (18) by means of the carrier air jet, directing an air flow ($L_{1b}$) of general ventilation downwards out of an intake air chamber (13) in the intake air unit (11) through a perforated plate (17) whereby a low impulse and a low flow velocity are obtained for the air flow ($L_{1b}$), in which case a detrimental sensation of draft in a working zone is avoided, providing the exhaust air opening (20) with fat filters (21), by means of said trap-air flow ($L_{1a}$), gathering of excessive heat and/or of impurities and/or of excessive humidity at the proximity of the false-ceiling plate (25) in the false-ceiling construction

(10) in the area between the intake air unit (11) and the exhaust air unit (18) is prevented, and directing the air out from the room space (H) through the exhaust air opening (20).

5. Method as claimed in claim 4, further comprising directing the carrier-air jet out of the intake air chamber (13) in the intake air unit (11) through a number of air flow openings (15) provided for the carrier-air jet in different length positions in the intake air chamber (13).

* * * * *